United States Patent [19]

Hicks et al.

[11] 4,275,384

[45] Jun. 23, 1981

[54] PORTABLE MEDICINE CABINET WITH TIMER

[76] Inventors: Thurmond A. Hicks; Brenda G. Hicks, both of 2433 Middleton Dr., Gastonia, N.C. 28052

[21] Appl. No.: 45,275

[22] Filed: Jun. 4, 1979

[51] Int. Cl.[3] ..... G08B 5/00

[52] U.S. Cl. ..... 340/309.4; 221/2; 340/309.1

[58] Field of Search ..... 221/2; 340/309.4, 309.1

[56] References Cited

U.S. PATENT DOCUMENTS 3,762,601 10/1973 McLaughlin ..... 221/2

*Primary Examiner*—Harold I. Pitts

*Attorney, Agent, or Firm*—W. Thad Adams, III

[57] ABSTRACT

A portable medicine cabinet with timer for private use by an individual taking several different medicines and which may be carried from the home to the office or the like so as to assure that an individual does not either become confused and forget to take doses of certain prescribed medicines, or take doses of the prescribed medicine too often so as to endanger his health. The disclosed apparatus comprises a cabinet having a plurality of freely accessible compartments therein and time computer means into which a plurality of predetermined time intervals for taking a dose of the respective medicines may be entered. An indicator means is electrically connected to the time computer means and indicates the predetermined time intervals and which of the medicines should be removed from its respective compartment.

4 Claims, 1 Drawing Figure

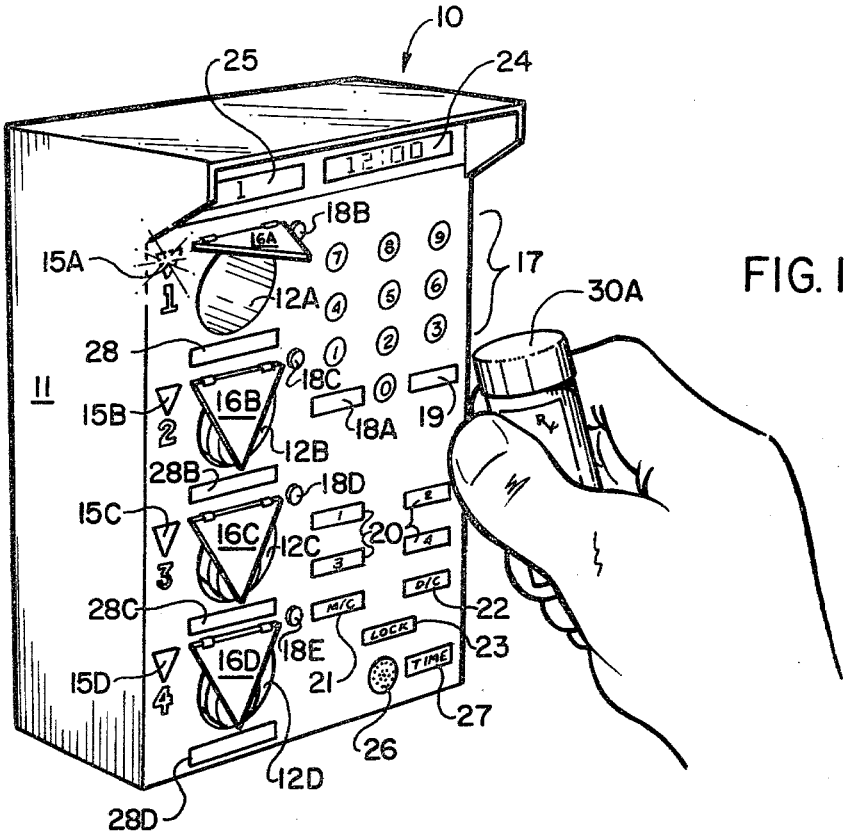
FIG. 1
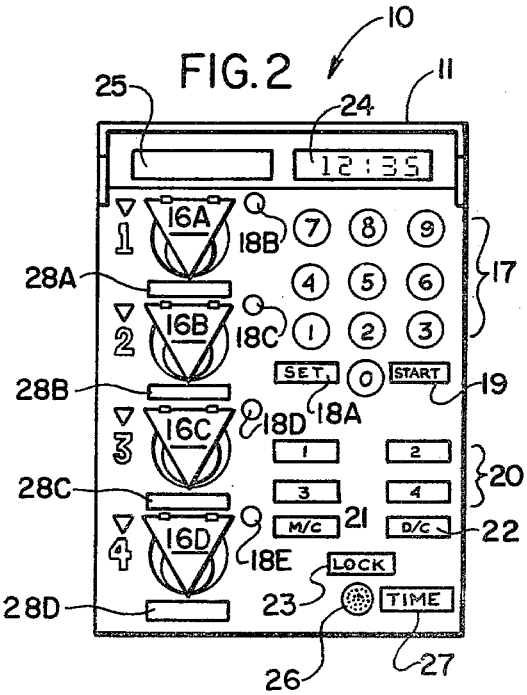
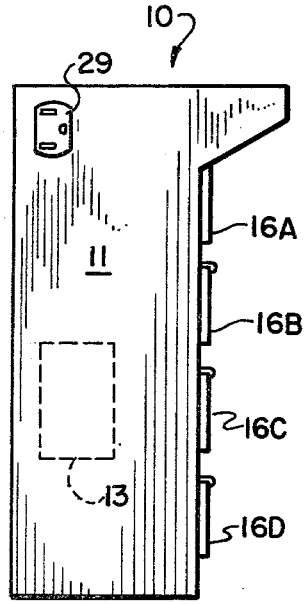
FIG. 3
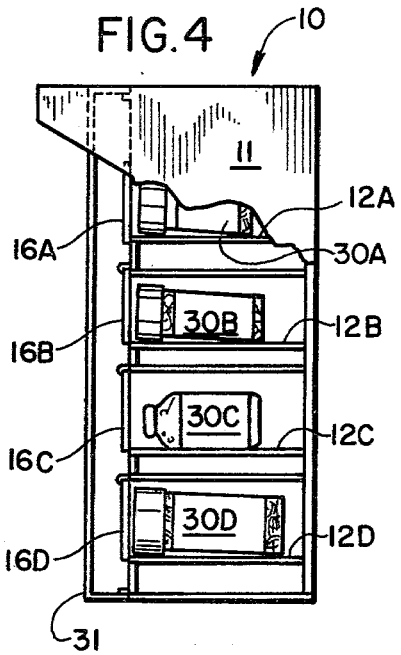

PORTABLE MEDICINE CABINET WITH TIMER

BACKGROUND OF THE INVENTION

The present invention relates to a portable medicine cabinet with a timer for private use by an individual taking several different medicines, and is adapted for storing the plurality of medicines therein and indicating at certain predetermined time intervals that a dose of medicine should be taken.

Many individuals in today's society are taking several prescription drugs during the same period of time and it is believed that a problem exists in keeping track of the predetermined times for taking a dose of the respective medicines. This is believed to be a particular problem for senior citizens or disabled individuals who are living at their home or at the home of a relative or friend and whose memory may be less clear than the memory of younger or healthier individuals. For these people a portable apparatus of the type described herein is believed to be a valuable aid in keeping their assorted medicines at one location and indicating to them the exact time at which a dose of each medicine should be taken. It is not believed thay any portable apparatus of this kind is known at the present time and it is further believed that the apparatus of the present invention provides a simple and economical solution to a real problem existing in our society today .

Therefore, it can be understood that an object of the invention is to provide a portable medicine cabinet with a timer which may be used by individuals who are taking several medications at one time, particularly the sick and elderly, to maintain their medicines in a portable container and provide a signal to the individual when it is time to take a dose of each medicine.

Another object of the invention is to provide an inexpensive portable medicine cabinet with a timer for home or work utilization by any individual who is taking several medicines at one time and desires aid in keeping track of the time that a dose of each medicine should be taken.

BRIEF DESCRIPTION OF THE DRAWINGS

Other objects will become apparent from the following specification when taken in conjunction with the accompanying drawings, in which:

FIG. 1 is a perspective of the portable apparatus of the present invention for storing a plurality of different medicine bottles and indicating at certain predetermined times that a dose of medicine should be taken;

FIG. 2 is a front elevational view of the portable apparatus of the present invention with the medicine secured within the respective compartments thereof;

FIG. 3 is a side elevational view of the portable apparatus of the present invention showing the time computer means in phantom lines within the cabinet; and FIG. 4 is a side view, partly in section, of the portable apparatus of the present invention with the snap-on cover secured thereto.

DETAILED DESCRIPTION OF THE INVENTION

Referring to FIGS. 1–3, the portable medicine cabinet with timer is shown and generally designated 10. The portable apparatus 10 of the present invention comprises a cabinet 11 which contains recessed compartments 12*a*, 12*b*, 12*c*, and 12*d*, into each of which a bottle or vial of medicine may be placed. A time computer means 13 (FIG. 3) is contained within the cabinet 11 and includes entry means for entering predetermined time intervals for taking a dose of the medicine contained within the compartments 12*a*, 12*b*, 12*c*, 12*d*, and includes means for providing output signals at the predetermined time intervals. Indicator means 15*a*, 15*b*, 15*c*, 15*d* are each electrically connected to the time computer means and are positioned adjacent the compartments 12*a*, 12*b*, 12*c*, 12*d*, respectively, for indicating upon receipt of an output signal from the time computer means 13 which medicine should be removed and a prescribed dose thereof taken.

The cabinet 11 of the portable apparatus 10 of the present invention, typically being constructed of a lightweight plastic or other suitable material, includes doors 16*a*, 16*b*, 16*c*, 16*d* pivotally secured thereto and being urged downwardly into a closed position over the open end of the compartments 12*a*, 12*b*, 12*c*, 12*d*, respectively. Thereby, the doors 16*a*, 16*b*, 16*c*, 16*d* will normally retain the individual bottles of medicine within their respective compartments within the cabinet 11 even though the cabinet may be tilted or turned during transportation.

The time computer means 13 contained within the cabinet 11 is of the type commonly known in the time computer industry as a "chip" and may be similar to the one chip LSI, C-MOS-LSI crystal oscillator, fork type such as is utilized in the CASIO CQ-1 computerized calculator and clock. The entry means for entering a plurality of predetermined time intervals comprises a set of calculator buttons 17 for the digits 0 through 9 and further includes set buttons 18*a*, 18*b*, 18*c*, 18*d*, 18*e* and a start button 19. Also provided are four buttons 20, each of which corresponds to a respective compartment 12*a*, 12*b*, 12*c*, 12*d*, a memory clear button 21, a display clear button 22, an entry locking button 23 and a "time" button 27. A light emitting diode screen 24 is utilized to display the time in digital numbers and a second light emitting diode screen 25 is utilized for designating the number of the particular compartment from which a dose should be taken. The indicator means 15*a*, 15*b*, 15*c*, 15*d*, which as noted above are also energized by the time computer means when the predetermined time arrives to take a dose of a medicine, may suitably each be a signal light or bulb. In addition, the portable apparatus includes an electronic buzzer 26 which will sound at the predetermined time with an electronic tone so as to audibly signal the individual who is taking the medicines.

As is best shown in FIG. 3, the portable apparatus of the present invention has an AC adapter socket 29 so that the unit may either be energized by a self-contained battery or may be plugged into an AC outlet through the use of an adaptor. As clearly shown in FIGS. 1 and 2, the cabinet 11 also provides a ceramic name plate 28*a*, 28*b*, 28*c*, 28*d* for each of the recessed compartments 12*a*, 12*b*, 12*c*, 12*d* so that the name of the medicine placed within the compartment may be written on the name plate with a grease-type pencil and may easily be erased.

In FIG. 4 the individual recessed compartments 12*a*, 12*b*, 12*c*, 12*d* are shown each containing a bottle of medicine 30*a*, 30*b*, 30*c*, 30*d*, respectively. A snap-on cover 31 is provided to snap onto the front of the cabinet 11 so as to protect the portable apparatus during storage or periods of nonuse. The cover 31 allows the user to place the portable apparatus of the present invention into a drawer, cabinet or other suitable place for storing until it is needed again.

OPERATION

In operation, an individual who, by way of example, is taking four separate medicines requiring a dosage to be ingested at four different intervals would initially place the medicine bottles 30*a*, 30*b*, 30*c*, 30*d* into their respective compartments 12*a*, 12*b*, 12*c*, 12*d*. Thereafter, each medicine would be programmed into the time computer means 13. For example, if it is 1:00 P.M. and an individual has a first prescription drug which requires that a dose be taken every four hours, he would place it into compartment 12*a*. Next, the button representing digit 4 of the program entry means would be depressed, the set button 18*b* adjacent compartment 12*a* would next be depressed, the three digits 500 of the program entry means depressed (representing the time that the first dose of the medicine should be administered), and the set button 18*b* beside compartment 12*a* is again depressed and set button 18*a* is depressed. Finally, to start and lock the program into the time computer means, the lock button 23 and the start button 19 are depressed. This effectively programs the time computer means to first alert the individual at 5:00 P.M. that the first dose of medicine in compartment 12*a* should be taken and every four hours thereafter the alert will be repeated. When a dose of the medicine in compartment 12*a* should be taken, the associated signal light 15*a* and electronic buzzer 26 will be energized by output signals from the time computer means and simultaneously the output signals will energize the second LED 25 to show the digit 1 and the first LED screen 24 to show the correct time. At all times other than when a dose of the medicine is due, the LED screens 24 and 25 are not energized unless the time button 27 is depressed. If the time button 27 should be depressed, then the time will be immediately displayed on the LED secreen 24 until the display clear button 22 is depressed.

The time intervals for taking second, third and fourth medicines are entered into the time computer means in the same fashion as set forth above for the first medicine. When the predetermined time has arrived for a dose of any of the respective medicines, the respective display light 15*a*, 15*b*, 15*c*, 15*d*, the LED screen 25 indicating the number of the compartment in which the medicine to be taken resides, and the electronic buzzer 26 will activate. In such a fashion the individual is continually reminded when a dose of a given medicine should be taken and he will not take the dose either too often or to forget to take the dose. In this manner any individual taking a number of medicines at the same time, particularly a sick or elderly person, will be able to conveniently and safely keep track of their medication time schedule. Also, in this manner several individuals may use the apparatus at one time by each selecting one or more of the individual compartments to contain their medicine.

To clear the LED screens 24 and 25 after a dosage of medicine has been taken from one or more of these compartments, the display clear button 22 is depressed and the screens will become de-energized until it is time to take a dose of another medicine. The memory clear button 21 is depressed in order to clear the existing program from the time computer means 13 and allows for re-programming for different medicines.

From the foregoing description, it will thus be evident that the present invention has provided a novel, portable apparatus for containing a number of medications being taken by an individual at one time and for alerting the individual when a dose of each medicine should be taken. The apparatus is safe and sanitary and capable of preventing errors in medication which heretofore have been potentially hazardous to an individual's health and well being.

In the drawings and specification, there is set forth a preferred embodiment of the invention, and while specific terms are employed to aid in understanding the invention, they are used in a generic and descriptive sense only and not for purposes of limitation—the invention being defined by the claims.

I claim:

1. A portable apparatus for private use by an individual taking several different medicines, said apparatus being adapted for storing a plurality of different medicine bottles and indicating at certain predetermined times that a dose of each medicine should be taken, comprising:

a cabinet defining a plurality of open-ended, freely accessible cylindrical compartments, each of said compartments being adapted for receiving a bottle of medicine and having a hinged door pivotally secured to said cabinet for closing said compartment and securing the bottle of medicine therein;

time computer means contained within said cabinet for determining the time for taking a dosage of each of the respective medicines, said time computer means having entry means for entering a plurality of predetermined time intervals for taking a dose of each of said respective medicines contained within said respective compartments and means for providing output signals at said predetermined time intervals; and a signal light positioned adjacent each of said compartments so as to be clearly visible when energized by said output signals and being electrically connected to said time computer means for indicating upon receipt of said output signals the respective medicine which should be removed and a prescribed dose thereof taken;

whereby an individual who is taking several different medicines which require that prescribed doses be taken at different times can assure that he does not become confused and forget to take certain doses or take the prescribed doses too often and endanger his health.

2. A portable apparatus according to claim 1 wherein said time computer means includes a first light emitting diode readout screen for displaying the time and a second light emitting diode readout screen designating the digital number of the particular compartment containing the medicine to be taken when the output signal relating to said compartment is generated by said time computer means.

3. A portable apparatus according to claim 1 wherein said time computer means includes means for clearing the plurality of predetermined time intervals entered into said time computer means.

4. A portable apparatus according to claim 1 including an electronic buzzer which emits an electronic tone when energized by said output signals.

* * * * *